US006000070A

United States Patent [19]

Bonin

[11] Patent Number: 6,000,070

[45] Date of Patent: Dec. 14, 1999

[54] COMBINATION TOILET AND BIDET

[76] Inventor: Pete J. Bonin, 8816 Yuba Cir. #1110-C, Huntington Beach, Calif. 92646

[21] Appl. No.: 09/196,024

[22] Filed: Nov. 19, 1998

[51] Int. Cl.[6] ..... E03D 9/05

[52] U.S. Cl. ..... 4/349; 4/252.3; 4/420; 4/420.2; 4/420.5; 4/425

[58] Field of Search ..... 4/252.2, 252.3, 4/349, 420, 420.2, 420.4, 420.5, 421, 425

[56] References Cited

U.S. PATENT DOCUMENTS

| | | |
|---|---|---|
| 4,091,473 | 5/1978 | Matthews et al. . |
| 4,168,552 | 9/1979 | Austin . |
| 4,185,335 | 1/1980 | Alvis . |
| 4,207,628 | 6/1980 | Ibel . |
| 4,407,025 | 10/1983 | Hennessey et al. . |
| 4,408,361 | 10/1983 | Rozek . |
| 4,439,874 | 4/1984 | Schrock . |
| 4,510,629 | 4/1985 | Jovy et al. . |
| 4,777,671 | 10/1988 | Kearns . |
| 5,067,186 | 11/1991 | Ayers . |
| 5,305,472 | 4/1994 | Eger . |
| 5,560,048 | 10/1996 | Root . |
| 5,608,923 | 3/1997 | Jaeckels et al. . |
| 5,630,234 | 5/1997 | Childs . |
| 5,647,069 | 7/1997 | Han et al. . |
| 5,652,971 | 8/1997 | Wokas . |
| 5,659,901 | 8/1997 | Derakhshan . |
| 5,737,780 | 4/1998 | Okita et al. . |

*Primary Examiner*—Robert M. Fetsuga
*Attorney, Agent, or Firm*—Gene Scott-atent Law & Venture Law

[57] ABSTRACT

A toilet provides a traditional water filled bowl with flushing action as well as a bidet in one unit. Heated air is forced into the toilet bowl interior and directed onto bidet washed surfaces for drying. Water is directed into the bowl under pressure for flushing and for operating the bidet. The upper rim of the toilet bowl contains a channel which dispenses flush water downwardly for cleaning the interior of the toilet during flushing. Flush water is also directed from two additional outlets to provide flushing action. The toilet is fixtured for wall mounting at an adjustable height which may be changed by merely repositioning mounting bolts on a pair of vertical supports. Sewage pipes are telescoping or extendable for accommodating a vertical positioning range.

11 Claims, 3 Drawing Sheets

COMBINATION TOILET AND BIDET

BACKGROUND OF THE INVENTION

1. Field of the Invention

This invention relates generally to toilets, and more particularly to a wall mounted combination toilet and bidet.

2. Description of the Related Art

The following art defines the present state of this field:

Okita et al, U.S. Pat. No. 5,737,780 describes a seat-lifting device having a pair of left and right units arranged on both sides of a stool in a toilet. The units are connected mutually by a connecting frame. Each unit has a guide portion and a cable-driving portion which are connected with a pair of conduits for guiding a cable. The guide portion has a static guide, a sliding plate slidably supported with the static guide, a seat-supporting member tiltably mounted on the sliding member, and a gas spring urging the rear portion of the seat-supporting member. The sliding pate is driven by the cable-driving portion through a loop of cable.

Derakhshan, U.S. Pat. No. 5,659,901 describes a personal hygiene fixture is provided as a retrofit unit designed to mount directly onto a toilet tank inlet, being interposed in the fresh water supply line where it attaches to the tank. The appliance has a diversion valve which diverts water from the supply line to a tube leading to an irrigation nozzle mounted to the underside of the toilet seat. The knob controlling the irrigation is part of the valve, and is thus rigidly mounted to the tank fill valve so that it is easy to install and operate. A second diversion valve with a flexible line leading to a douche wand can also be incorporated in the valve unit to provide a dual-function hygiene appliance.

Wokas, U.S. Pat. No. 5,652,971 describes a bidet attachment which can be retrofit to any conventionally sized toilet includes fittings for rigidly connecting attachment to the existing water supply line and toilet water tank, a valve for selectively controlling water flow through the device, a hand adjustable supply conduit extending between the seat and the toilet bowl having a remote end portion extending downwardly below a rear center portion of the seat into the toilet bowl, and an adjustable nozzle directed upwardly generally normal to the remote end portion, whereby water sprayed from the nozzle is directed on the rectal area of a user. The adjustable supply conduit includes a plurality of tube segments which are slidably connected with a plurality of corresponding elbow fittings.

Han et al., U.S. Pat. No. 5,647,069 describes a bidet apparatus includes a base plate fitted to an upper horizontal rim surface of a conventional toilet. A rear nozzle block is pivotally mounted to the base plate and includes two separate water inlets connected to two separate nozzles. Each nozzle includes a plurality of holes to spray water at an angle at the posterior and genital areas of a user. Two valves are mounted to the base plate each having on inlet connectable to a pressurized water source, and one outlet, with each of the outlets being connected to a respective one of the separate water inlets. Conduits connect the separate water inlets to the valve outlets. A position handle is mounted to the base plate and includes a handle shaft moveable in back and forth motion for adjusting the position of the rear nozzle block. A linkage is connected between the rear nozzle block and the position handle for moving the rear nozzle block to an in-use position in response to movement of the handle shaft.

Childs, U.S. Pat. No. 5,630,234 describes a bidet assembly for use with a toilet having a toilet seat is disclose. The bidet assembly provides a bidet seat to be coupled rotably to the toilet to be movably between a raised position and a lowered position over the toilet seat on the toilet bowl. The bidet seat defines a central opening. A nozzle for providing a fluid flow therethrough is connected to the bidet peat proximate the central opening. The nozzle is thus movable with the bidet seat when the bidet seat is coupled to the toilet. When coupled to a conventional toilet, the bidet seat is rotated into position atop the toilet seat only when the user wishes to use the bidet assembly. Thus, the bidet nozzle and any attached water supply are protected from contamination by the toilet. When the bidet assembly is not in use, the bidet seat is rotated to a raised position.

Jaeckels et al., U.S. Pat. No. 5,608,923 describes a toilet has a pump to deliver selected quantities of water from a reservoir to a toilet bowl so as to effect a water savings. In one aspect, both the motor and pump are positioned in the reservoir to deliver water to both the rim and bowl portions. In another aspect, there are conduits connected between the basin, the rim and controls which are provided to deliver water to the rim and bowl either independently, simultaneously or in selective sequences. In alternative embodiments, a refill tube is connected to an intake conduit and the rim of the bowl to effect a water seal, a fail safe valve is connected to the supply conduit, a receptacle with a cleaning fluid and a pump is connected to the bowl and there are at least two receptacles for receiving waste.

Root, U.S. Pat. No. 5,560,048 describes an exhaust collector comprising an underside intake secured within the interior of a toilet by a detachable add compressible mounting of the connecting conduit to the sidewall through which it extends to draw discharged odoriferous gases away from the person or the user by means of biased air.

Eger, U.S. Pat. No. 5,305,472 describes a toilet ventilation unit including a vacuum motor mounted in the wall voids surrounding the toilet that is connected to the back of the tank and utilizes the water passageway of a conventional toilet to draw odors and aromas from the toilet. A vacuum shut off valve is mounted adjacent the back of the tank and is actuated concomitantly with the rising and lowering of the water level to cut off the air flow from the toilet. An additional valve is also mounted adjacent the tank to act in opposition to the shut-off valve and provide relief from the vacuum created from the drop of the water level during flushing. A release valve is adjacent the vacuum motor to draw air from an air source alternative to the toilet, when the shut-off valve is activated.

Ayers, U.S. Pat. No. 5,067,186 describes an infants bidet is provided, which folds out of the way over a toilet. The bidet comprises a container with a drainer platform, inclined surfaces that direct waste into a bowl, an elevated child bearing platform accessory shelves and height adjustment means.

Matthews et al., U.S. Pat. No. 4,091,473 describes an adjustable toilet mounted on the wall of a bathroom. The toilet is raised and lowered by an electrically driven motor. By raising and lowering the toilet, the elderly, the handicapped, and children are aided in the use of the toilet. The toilet provides electrical limit switches for stopping the motor at a desired height above the bathroom floor.

Kearns, U.S. Pat. No. 4,777,671 describes a toilet seat assembly is provided having a seat that is pivotably supported at its forward end for swinging movement between substantially horizontal and upwardly inclined positions. A power lift mechanism is incorporated in the assembly and is selectively operable by the user to pivot the seat and support the seat in a desired position assisting the user in moving between seated and standing positions. The power lift mechanism includes an expandable bladder of the bellows disposed at the rear of the seat assembly between a base structure adapted to be secure on the top of a toilet bowl and the pivoted seat that is also mounted on the base structure. A fluid control system is coupled with the expandable bladder and adapted to be connected with a source of pressurized fluid and has a manually actuated control valve operable by the user to permit admission of pressurized fluid into the bladder to cause its expansion and upward pivoting of the seat or to permit outflow of fluid from the bladder resulting in construction of the bladder and pivoting of the seat towards a horizontal position.

Schrock, U.S. Pat. No. 4,439,874 describes a quiet water closet rim and a method for venting air from a rim cavity of a water closet. The rim has a horizontally oriented annular cavity and is selectively supplied with pressurized water by a flush mechanism. A series of perforations in the rim permits the pressurized water within the rim cavity to exit the rim in the form of a spray. The rim is also provided with a vent passageway having an inlet open into an upper portion of the cavity and an outlet open into the atmosphere. As pressurized water fills the cavity, a portion of the air within the upper portion of the cavity is vented through the vent passageway.

Rozek, U.S. Pat. No. 4,408,361 describes a diverter valve for a fluid storage tank such as the storage tank of a water closet is disclosed. In one embodiment, the diverter valve has a housing with an inlet passage for receiving a supply of water and a pair of outlet passages. One of the outlet passages devlivers pressurized water from the diverter valve to the storage tank, and the other outlet passage delivers the pressurized water to a diversion conduit connected to the toilet bowl rim. The diverter valve also includes a movable flap mounted within the diverter valve which moves to proportion the flow of water between the two outlet passages in response to changes in the water level of the tank. The flap is initially positioned to direct water to the tank when the tank water level is high. The flap is then moved by a water level sensor wuch as a float to direct water to the bowl rim when the water level in the storage tank has emptied. A special bleed line in communication with the supply line is provided to allow a portion of the water supply to flow into the storage tank even when the water level is below the diversion level, so as to refill the tank.

Ibel, U.S. Pat. No. 4,207,628 describes a toilet seat and an overlying bidet basin replacing the toilet seat cover. The toilet seat has enlarged inward sloping opposite middle portions for the supportive engagement of the user's thighs and an opening including enlarged front and rear portions and a relatively narrow middle potion. The lack of any support areas in the front and rear portions positions the user into a semi-squat position, thighs and buttocks spread apart, legs angled upwardly, body bent forward at the waist, over the middle portion of a toilet bowl. The enlarged front and rear positions of the opening allow the insertion of the hand for blotting the wiping and preventing soiling. The bidet basin is pivoted down over and into the toilet seat and is consisting of a bidet seat portion which overlies the toilet seat and a bidet bowl portion which penetrates and covers the opening of the seat. The bidet seat portion has enlarged opposite middle portions for the support of the user's thighs, the user straddling the bidet basin facing to the rear with the perineum and genitals suspended over the front and middle portion of the bidet bowl portion. The human seat is situated over an enlarged front portion of the bidet seat opening and an enlarged rear portion of the opening is for the insertion of the hands for washing and rinsing purposes.

Alvis, U.S. Pat. No. 4,185,335 relates to a movable toilet seat assembly for the infirm which allows a user to manually control seat position from an essentially standing position to a seated position and vice versa with minimum stress on the user's legs and joints.

Austin, U.S. Pat. No. 4,168,552 describes a toilet seat to be raised or lowered over a conventional toilet bowl by a power control operated by the user. A pair of jacks, each having a rotary drive shaft, are disposed on each side of the bowl and are connected to a mounting plate which support the seat. The two jacks shafts are mechanically interconnected through a drive, which is located rearwardly and beneath the toilet bowl so that each jack will be raised or lowered the same distance thereby avoiding tilting. The mechanical interconnection is preferably a belt to lesson operating noise, but a chain and sprocket assembly could be used. A reversible electric motor acts as a power source to operate the drive. One jack shaft is pivotly mounted on its supporting base so as to adjust the position of its connected drive shaft to thereby tighten the belt type of drive to which the drive shaft is connected. A protective cover is located above the drive shaft to prevent any portion of the user clothing from becoming entangled within the drive.

Jovy et al., U.S. Pat. No. 4,510,629 describes a method of and apparatus for flushing a water closet by utilizing water and air for the flushing. The method operates at predetermined pressure ratios. AT an air pressure of maximally about 3 bar inside of a pressure vessel the flushing medium consisting of air/water is fed into the pressure vessel, and if the pressure exceeds 3 bar, water only is fed into the pressure vessel. In order to feed water and air a water-jet injection is used which on the one hand communicates via an infeed line with the water mains and on the other hand communicated via an infeed stub at the suction side with the ambient air. The air/water mixture is fed through an infeed line into the pressure vessel, which infeed line ends in a space of the pressure vessel which is occupied by an air cushion. The relative pressures allows a two step flushing which is governed by an accordingly designed discharge valve in the outflow conduit of the pressure vessel Hennessey et al., U.S. Pat. No. 4,407,025 describes a water-conserving toilet is disclosed and includes a bowl for receiving waste and a waste outlet extending laterally from the bowl and defining a first, shallow trap arranged so that a relatively shallow body of liquid is normally retained in the bottom of the bowl for preventing gaseous flow through the trap. A flush system is provided and is arranged, when operated, to deliver a charge of flushing liquid into the bowl in a direction to cause said body of liquid to be discharged through said outlet for receiving waste from the bowl. An outlet extends outwardly from the chamber and is adapted for connection to a sewer inlet. The chamber outlet defines a second trap of substantial height capable of preventing reverse flow of sewer gas into the chamber in use. The toilet also includes means communicating with the chamber and adapted to relieve increase in gas pressure caused by liquid entering the chamber from the bowl, whereby back pressure resistance to flushing of liquid from the bowl is reduced.

The prior art teaches vertically adjustable toilets, ventilated toilets, bidet accessory kits, and various hardware items and designs for improving the operation and range of capabilities of a toilet. However, the prior art does not teach a combination unitized construction embodying a toilet and bidet with washing and drying capability and vertical wall mounting capability. The present invention fulfills these needs and provides further related advantages as described in the following summary.

SUMMARY OF THE INVENTION

The present invention teaches certain benefits in construction and use which give rise to the objectives described below.

The present invention provides a toilet having a traditional water filled bowl with flushing action as well as a bidet in one unit. Heated air is forced into the toilet bowl interior and directed onto bidet washed surfaces for drying. Water is directed into the bowl under pressure for flushing and for operating the bidet. The upper rim of the toilet bowl contains an annular channel which dispenses flush water downwardly for cleaning the interior of the toilet during flushing. Flush water is also directed from two additional outlets to provide thorough flushing action and impulse evacuation with a small quantity of water per flush. The toilet is fixtured for wall mounting at an adjustable height which may be changed by merely repositioning mounting bolts on a pair of vertical supports. Sewage pipes are telescoping or extendable for accommodating a vertical positioning range.

A primary objective of the present invention is to provide combination toilet-bidet having advantages not taught by the prior art.

Another objective is to provide such a combination as a wall mountable assembly.

A further objective is to provide such a combination having odor sealing capability.

A still further objective is to provide such a combination with both heated water and air for a bidet feature.

A still further objective is to provide such a combination with an ultra-clean look by storing the water tank and all other equipment behind the wall on which the invention is mounted.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 4:
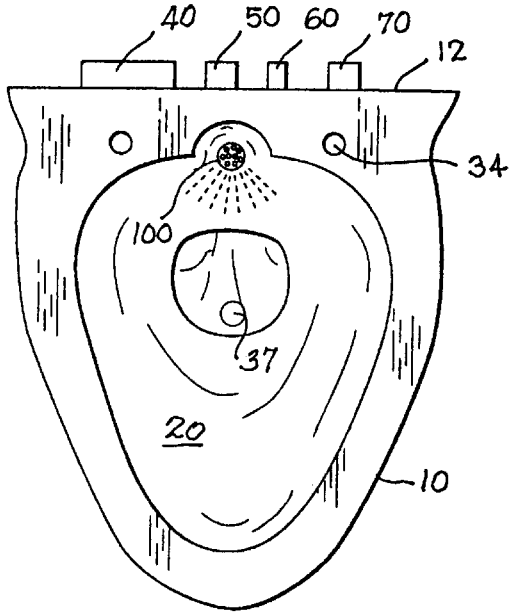
FIG. 4 is a plan view thereof.
Figure 5:
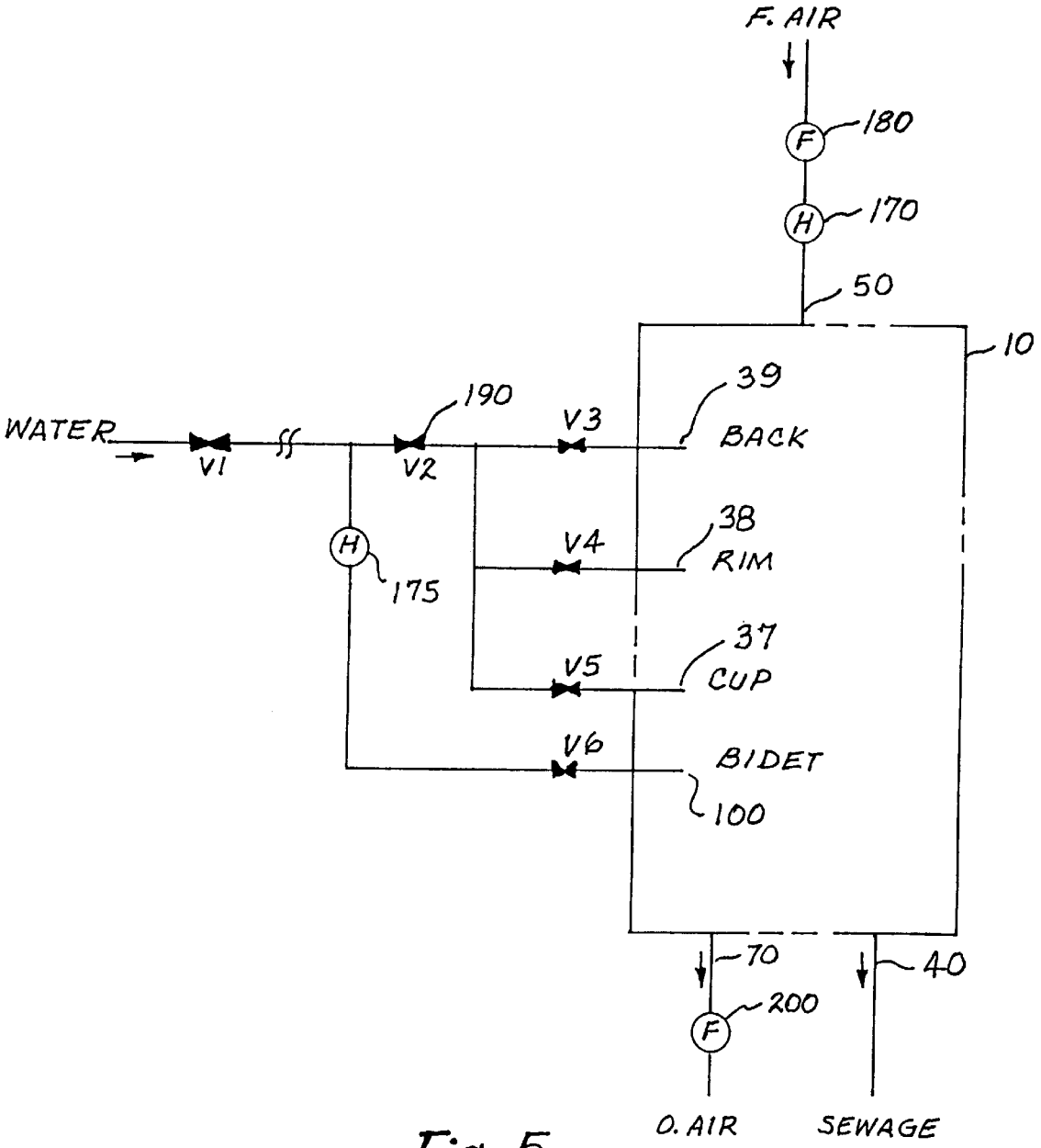
FIG. 5 is a schematic diagram of the water and air flows and controls in the present invention.

The above described drawing figures illustrate the invention, a combination toilet and bidet apparatus 5 comprising: a toilet bowl 10 of typical material such as vitreous and having an interior surface 20, the toilet bowl 10 providing an upper rim 30 having an upper surface 32 with a means for mounting a toilet seat 34 thereto such as bolt holes as is well known and shown in FIG. 4, and for the operation of the toilet bowl 10, with h respect to fluids: a means for passing sewage 40 out of the toilet bowl 10, a means for passing fresh air 50 into the toilet bowl 10, a means for passing fresh water 60 into the toilet bowl 10, a means for passing odorous air 70 out of the toilet bowl 10. Preferably, the means for passing sewage 40, means for passing fresh air 50, the means for passing fresh water 60 and the means for passing odorous air 70 are common plumbing stubs located on a rear wall 12 of the toilet bowel 10. Clearly many possible physical arrangements of the stubs may be designed and it is not the intention of this invention to teach a particularly superior such design. FIG. 5 teaches the preferred interconnection and arrangement of fluid conduits and the control thereof. This will be described in greater detail below.

A means, within the toilet bowl, is provided for producing an upwardly directed bidet water spray 100, preferably, a spray producing nozzle mounted within the toilet bowl 10 on the interior surface 20 thereof.

A toilet seat 110 is preferably engaged with the toilet seat mounting means 34 of the toilet bowl 10, by common fastener means (not shown) for securing the toilet seat 110 to the toilet bowl 10. The toilet seat 110 provides a means for sealing 120, preferably an annular gasket secured to the underside surface 112 of the toilet seat 110 and adapted for being pressed between the underside surface of the toilet seat 112 and the upper surface 32 of the toilet bowel 10 (FIG. 3) so as to prevent odorous air within the toilet bowl 10 from rising above the toilet seat 110 when the toilet seat is occupied by a person.

Figure 3:
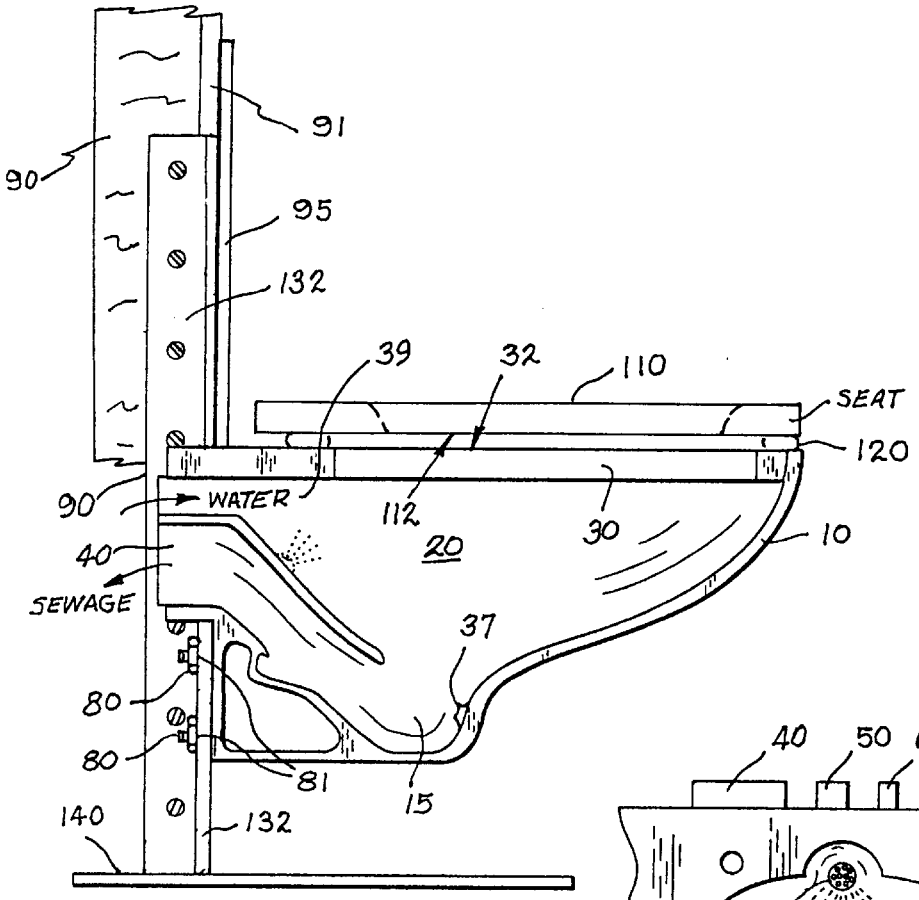
FIG. 3 is a side elevational sectional view of the wall-hung embodiment showing further details of construction.

Also, as shown in FIG. 3, the combination toilet further comprises a means, such as a plurality of captured threaded studs, enabling mounting 80 of the toilet bowl 10 to a wall 90. Therefore the toilet bowl 10 may be positioned at a selected vertical position relative to a floor surface 140. Preferably, the means adapted for adjustably mounting 80 the toilet bowl 10 at a selected vertical position engages a pair of spaced apart, vertically oriented, rigid mounting strips 132 integrally and rigidly engagable with the fixed wall 90, the mounting strips 132 providing multiple selectable means, such as a series of spaced apart mounting holes 81, for engaging the studs 80 integral with the rear wall 12 of the toilet bowl 10 such that the toilet bowl 10 may be set at a desired vertical position along the mounting strips 132 and rigidly bolted in place so as to be immobile and able to support the weight of an individual. In FIG. 3 the edge of one of the mounting strips 132 is visible while the second such strip is not visible due to the cutaway view. In a preferred manner of construction in the present invention the mounting strips 132 define a portal to a space behind the toilet 10 and wall 90 wherein a water tank, valves and other equipment of the present invention may be mounted out of general view. An access panel 95, as shown in FIG. 3, may be used to conceal such a portal and this panel 95 may also be fastened in a common manner to the strips 132. Therefore, it may been seen in the present invention, that the toilet 10 may be raised or lowered as desired, over a considerable range of motion, without exposing any hardware, water lines or valves, and especially without plumbing alterations.

Figure 1:
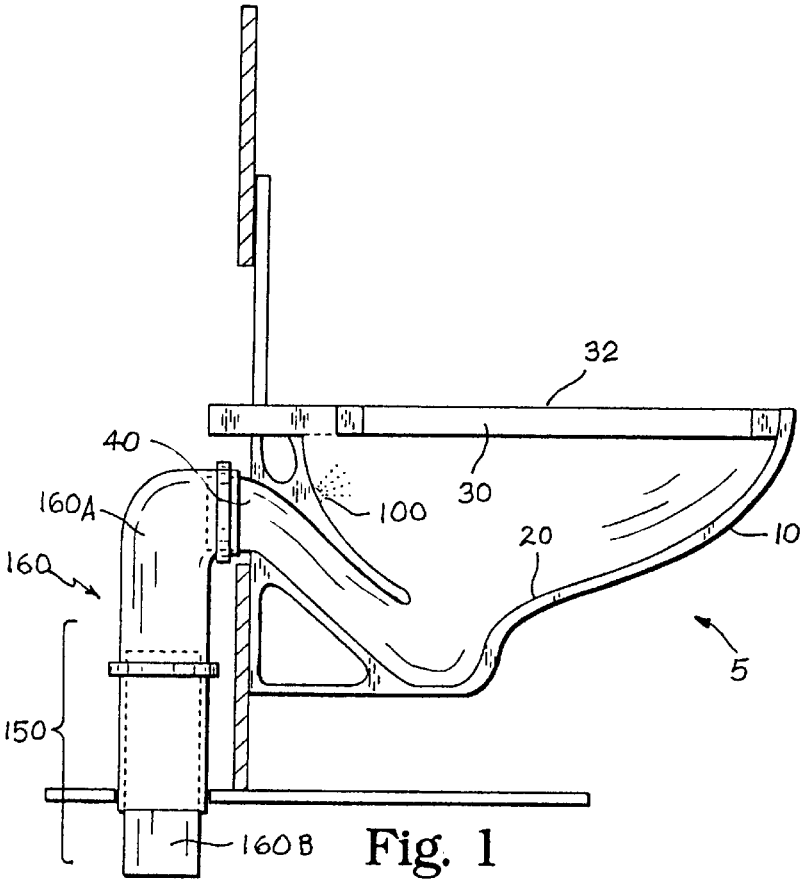
FIG. 1 is a side elevational sectional view of a wall-hung embodiment of the present invention.
Figure 2:
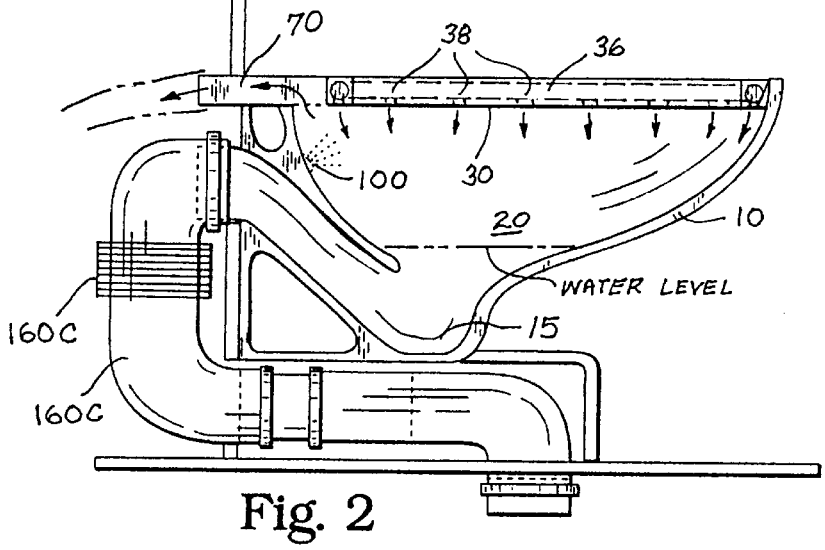
FIG. 2 is a side elevational sectional view of a floor-mount embodiment of the present invention.

Preferably, as seen in FIGS. 1 and 2, the present invention includes a means for adjusting the length 150 of a sewage receiving conduit 160 engaging the means for passing sewage 40 out of the toilet bowel 10, so as to accommodate adjustment in the vertical position of the toilet bowl. the length adjusting means 150 may comprise a first sewage conductor 160A engaged with the sewage passing means 40 of the toilet bowl 10 for receiving sewage therefrom, and a second sewage conductor 160B telescopically engaged with the first sewage conductor 160A for extension thereof. The length adjusting means 150 may alternately comprise a first sewage conductor 160C having a flexible bellows shaped wall 162 for extending and contracting to a length as needed for positioning the toilet bowl 10 vertically. Other means for extension accommodation will be known to those of skill in the art.

Preferably, a channel 36 is formed within the upper rim 30, the channel 36 being adapted for receiving fresh water from the fresh water passing means 60, the channel 36 providing a plurality of downwardly directed outlets 38 positioned and directed for flushing the interior surface 20 of the toilet bowl 10. Preferably, the volume of water held within the channel 36 is sufficient to refill the bowl after a flush has lowered the water level. Two other flush water inlets into the toilet bowl are placed for an improved flush action; as shown in FIG. 3, a bulk of the flush water is brought into the toilet bowl from the rear as inlet 39; also a strong water jet producing nozzle 37 is located in the cup 15 of the bowl and is positioned so as to direct a jet of water toward the sewage passing means 40. This jet produces added momentum to force evacuation so that less flush water is required, typically only 1.6 gallons per flush. Valves V2–V5 are controlled to actuate, to an extent and in a timed manner such that a most efficient flush action is achieved. V2 is actuated manually by the person leaving the toilet or by a remote sensor providing this information and opens first to start the flush cycle. Next V3 opens to allow a bulk of flush water to enter at entry 39. Immediately thereafter V5 is actuated with a strong burst to help drive sewage to the exit 40. Finally, V4 is actuated to clean the bowl surface 20 and to refill the bowl. V1 is a main and provides overall throttle control so as to adapt the invention to water main pressure or tank head. V6 is manually adjustable by the person using the facility so as to control the amount and duration of washing. Likewise, manual control is provided for fan 180, air heater 170, water heater 175 so that complete control over the toilet is enabled.

As shown in the schematic of FIG. 5, preferably, the invention further comprises a means for heating 170 such as an electric air heater, and a means, such as a fan, for urging 180 fresh air into the air passing means 50. This air is conducted to the means for water spray 100 and is then forcefully ejected and directed as a means for drying those surfaces that have been washed. Please note, as seen in FIG. 5, the bidet water is conducted through a small water heater 175 so as to produce warm water for washing. Finally, the invention preferable includes a means, such as a fan, for exhausting 200 odorous air from the toilet bowl 10. These components, also, are preferably concealed behind the access panel 91. A bidet water and air control knob, lever or button (not shown) is preferably mounted on one side of the toilet for manipulation by the user.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination toilet and bidet apparatus comprising:

a toilet bowl having an interior surface, the toilet bowl providing an upper rim having an upper surface with a means for mounting a toilet seat thereto, means for passing sewage out of the toilet bowl, means for passing air into the toilet bowl, means for passing fresh water into the toilet bowl, means for passing odorous air out of the toilet bowl, means enabling mounting of the toilet bowl to a wall; means, within the toilet bowl, for producing an upwardly directed bidet water spray;

a toilet seat engaged with the toilet seat mounting means of the toilet bowl for securing the toilet seat to the toilet bowl, the toilet seat providing a means for sealing the toilet seat to the upper surface the toilet bowl so as to prevent odorous air within the toilet bowl from rising above the toilet seat when the seat is occupied by a person; and means adapted for adjustably mounting the toilet bowl at a selected vertical position relative to a floor surface.

2. The apparatus of claim 1 wherein the means for passing sewage, means for passing air, means for passing fresh water and means for passing odorous air are plumbing stubs located on a rear wall of the toilet bowel.

3. The apparatus of claim 1 wherein the means for producing an upwardly directed bidet water spray is a spray producing nozzle mounted within the toilet bowl on a rear surface thereof.

4. The apparatus of claim 1 wherein the means for sealing the toilet seat to the upper surface the toilet bowl is an annular gasket secured to an underside surface of the toilet seat and adapted for being pressed between the said underside surface of the toilet seat and the upper surface of the toilet bowel.

5. The apparatus of claim 1 wherein the means adapted for adjustably mounting the toilet bowl at a selected vertical position relative to a floor surface comprises a pair of spaced apart, vertically oriented rigid mounting strips integrally and rigidly engagable with a fixed wall, the mounting strips providing multiple selectable means for engaging a plurality of fasteners integral with the rear wall of the toilet bowl such that the toilet bowl may be set at a desired vertical position along the mounting strips.

6. The apparatus of claim 5 further including a means for adjusting the length of a sewage receiving conduit engaging the means for passing sewage out of the toilet bowel, so as to accommodate adjustment in vertical position of the toilet bowl.

7. The apparatus of claim 6 wherein the length adjusting means comprises a first sewage conductor engaged with the sewage passing means of the toilet bowl for receiving sewage therefrom, and a second sewage conductor telescopically engaged with the first sewage conductor for extension thereof.

8. The apparatus of claim 6 wherein the length adjusting means comprises a first sewage conductor having a flexible bellows shaped wall for extending and contracting to a length as needed for positioning the toilet bowl vertically.

9. The apparatus of claim 1 further comprising a channel within the upper rim, the channel adapted for receiving fresh water from the fresh water passing means, the channel providing a plurality of downwardly directed outlets positioned and directed for flushing the interior surface of the toilet bowl.

10. The apparatus of claim 1 further comprising means for heating and urging fresh air into the air passing means, means for throttling fresh water flow into the toilet bowl for flushing thereof and for a bidet spray therein, means for exhausting odorous air from the toilet.

11. The apparatus of claim 1 further including a water jet producing nozzle positioned within the toilet bowl for directing water toward the sewage passage means.

* * * * *